US011035641B2

(12) United States Patent
Brown

(10) Patent No.: US 11,035,641 B2
(45) **Date of Patent: *Jun. 15, 2021**

(54) BOW RISER WITH INTEGRATED CENTRAL ACCESSORY MOUNT

(71) Applicant: Brown Innovations, LLC, London, KY (US)

(72) Inventor: Kevin E. Brown, London, KY (US)

(73) Assignee: BROWN INNOVATIONS, LLC, London, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/816,451

(22) Filed: Mar. 12, 2020

(65) Prior Publication Data

US 2020/0208938 A1 Jul. 2, 2020

Related U.S. Application Data

(63) Continuation of application No. 16/224,976, filed on Dec. 19, 2018, now Pat. No. 10,634,448, which is a continuation-in-part of application No. 16/015,272, filed on Jun. 22, 2018, now Pat. No. 10,330,424.

(60) Provisional application No. 62/526,064, filed on Jun. 28, 2017.

(51) Int. Cl.

| | |
|---|---|
| ***F41G 1/467*** | (2006.01) |
| ***F41B 5/00*** | (2006.01) |
| ***F41B 5/14*** | (2006.01) |

(52) U.S. Cl.

CPC ..... *F41B 5/1403* (2013.01); *F41B 5/0005* (2013.01); *F41B 5/0031* (2013.01); *F41B 5/14* (2013.01); *F41B 5/148* (2013.01); *F41B 5/1492* (2013.01); *F41G 1/467* (2013.01)

(58) Field of Classification Search

CPC ..... F41B 5/14; F41B 5/1403; F41B 5/143; F41B 5/1484; F41G 1/467

See application file for complete search history.

(56) References Cited

U.S. PATENT DOCUMENTS

| | | | |
|---|---|---|---|
| 3,406,675 | A | 10/1968 | Fredrickson |
| 3,561,418 | A | 2/1971 | Fredrickson |
| 4,759,337 | A | 7/1988 | Suski |
| 5,005,554 | A | 4/1991 | Shepley et al. |
| 5,341,791 | A | 8/1994 | Shafer |
| 5,386,814 | A | 2/1995 | Denton |
| 5,400,764 | A | 3/1995 | Spolar et al. |
| 6,142,134 | A | 11/2000 | Meeks |
| 6,889,683 | B1 | 5/2005 | Smith |

(Continued)

*Primary Examiner* — John A Ricci

(74) *Attorney, Agent, or Firm* — King & Schickli, PLLC

(57) ABSTRACT

An archery bow with a riser including a mount in a centerline plane of the riser above a lower wall of a sight window of the riser may allow for a novel manner of mounting an archery accessory. Placement of the mount within a centerline plane of the riser may maintain the weight of the archery accessory along a center of the bow, thereby reducing or eliminating asymmetrically weighted bows or the need for an additional stabilizer to balance the weight of the archery accessory. Positioning the mount above the lower wall of the sight window additionally allows for coordination of the position of a secondary accessory, such as a sight, a light, or a camera, in addition to mounting an arrow rest, such as in a lower wall of the sight window, while maintaining the centralized weight advantages noted above.

31 Claims, 13 Drawing Sheets

(56) References Cited

U.S. PATENT DOCUMENTS

| | | | | |
|---|---|---|---|---|
| 7,347,196 | B1 | 3/2008 | Shepley, Jr. et al. | |
| 7,401,411 | B2 | 7/2008 | White | |
| 8,596,256 | B2 | 12/2013 | McPherson | |
| 9,383,169 | B2 | 7/2016 | Donovan | |
| 10,330,424 | B2 | 6/2019 | Brown | |
| 10,634,448 | B2 * | 4/2020 | Brown | F41B 5/0031 |
| 2004/0007224 | A1 | 1/2004 | Brown, Jr. | |

* cited by examiner

BOW RISER WITH INTEGRATED CENTRAL ACCESSORY MOUNT

This application is a continuation of U.S. application Ser. No. 16/224,976, filed on Dec. 19, 2018, which is a continuation-in-part of U.S. application Ser. No. 16/015,272, filed on Jun. 22, 2018, which claims priority to U.S. PROVISIONAL Application Ser. No. 62/526,064, filed on Jun. 28, 2017, the disclosures of which are hereby incorporated by reference.

TECHNICAL FIELD

This invention generally relates to a projectile weapon, and more particularly to an archery bow with a handle riser including an integrated means for attaching an accessory for the bow.

BACKGROUND OF THE INVENTION

Archery bows include risers 10, which generally form a central body of the bow. With reference to the prior art of FIG. 1, these risers 10 may include an upper end 12 and a lower end 14, which may have limb attachment points where cams may be located. A handle 16 may be positioned between the upper and lower ends for gripping by a user during use.

A sight window 20 may be included above the handle 16, which may provide a location from which an arrow is shot from the bow. The sight window 20 may include a lower wall 22, which is sometimes referred to as an arrow shelf, and may further include at least one vertical wall 24, which in turn may connect to an upper wall 26. The upper wall 26 may be horizontal, may project at an angle upward from horizontal, or may be curved. The upper wall 26 may connect the sight window 20 to the upper end 12 of the riser 10.

As can be seen in the prior art of FIG. 2, the riser 10' may be in the form of a shoot-through riser, which may include two vertical walls 24*a*, 24*b*, that may connect the lower wall 22 to the upper wall 26. In such an embodiment, the sight window 20 may be considered a closed configuration, as opposed to the embodiment of FIG. 1, which includes only a single vertical wall 24, and would be considered to have an open configuration.

Accessories such as arrow rests, sights, cable guards, range finders, scopes, flashlights, cameras, fishing reels, and stabilizers are often attached to the riser, such as by way of the vertical wall 24. This is often accomplished through the use of one or more attachment means, such as a hole, on the vertical wall 24. For example, in some instances, a berger hole is used to mount an arrow rest. The sizes of these holes and thread specifications may be based on Archery Manufacturers' Organization (AMO) standards.

The accessories may be fastened from the outside of the vertical wall 24 of the sight window. This attachment arrangement may create certain problems, such as in the context of tuning the bow in order to center the accessory along a center plane of the riser and/or string. For example, because the accessory is attached from the outside of the sight window, at least some lateral positioning or adjustment may be required in order to center the accessory with respect to the riser and/or string.

In addition, the added weight of the accessory may compromise the balance of the bow riser, such as by shifting the center of gravity of the bow to the left or right. This may lead to the bow requiring one or more further weight stabilizers, such as a side stabilizer, a back bar, or a stabilizer weight slide bar to compensate for the added weight of the accessory. This addition of a stabilizing element simply adds further weight to the overall bow.

Accordingly, a need has been identified for a bow riser with an improved attachment system for accessories which addresses these and other shortcomings of traditional risers.

SUMMARY OF THE INVENTION

In one embodiment, the present invention generally relates to an archery bow riser comprising an upper end, a lower end, a handle above the lower end, and a sight window between handle and the upper end. The sight window may comprise a lower wall adjacent the handle, at least one vertical side wall, and an upper wall. The riser may further include at least one mount adapted to receive and attach an archer accessory to the riser, the mount being located above the lower wall and at least partially within a centerline plane of the archery bow riser. The archery accessory could be any of an arrow rest, a sight, a cable guard, a range finder, a scope, a flashlight, a camera, a fishing reel, a stabilizer, etc.

For purposes of this disclosure, the centerline plane is the plane through which a bowstring is adapted to travel when firing an arrow through the sight window of the bow riser. The centerline plane generally divides the riser in half between a left side and a right side.

In one aspect, the riser may further include a second vertical wall above the sight window, and the mount may be positioned on the second vertical wall.

The mount may comprise a recess adapted to receive at least a portion of the archery accessory. In one aspect, the mount may comprise an elongated groove running in a direction from a front to a back of the riser. The elongated groove may include at least one receiver adapted to engage the archery accessory and restrict movement of the archery accessory along the elongated groove. For example, the at least one receiver may be one or more indentations adapted to engage a detent associated with the archery accessory.

In another aspect, the mount may comprise an extension projecting from the riser. For example, the mount may comprise an extension running in a direction from a front to a back of the riser.

A second mount adapted for attaching a second archery accessory to the riser may be provided in or on at least one of the vertical side wall of the sight window or the lower wall. The second mount may be of the same configuration as the first mount, or may be of a different configuration.

The upper wall which includes the mount may be a generally horizontal wall. Alternately, the upper wall may extend from the at least one vertical side wall at an angle from horizontal greater than zero degrees. In one aspect, the upper wall may be a curved wall.

In another embodiment, the invention relates to an archery bow for use in association with a bowstring used to fire an arrow. The archery bow may comprise a riser including a centerline plane through which the bowstring is adapted to travel when firing said arrow. The riser may include a handle and a sight window above the handle, the sight window at least partially defined by a lower wall, a vertical side wall, and an upper wall. The archery bow may further comprise at least one first mount within the centerline plane, said mount being above the lower wall of the sight window and adapted to attach an archery accessory to the bow.

At least one of the vertical side wall of the sight window and the lower wall may include at least one second mount adapted to attach a second archery accessory to the bow. The first mount and the second mount may be of the same shape. Alternately, the first mount and the second mount may be different shapes.

In one aspect, the first mount may comprise a recess. The recess may be a threaded aperture adapted to receive a threaded projection associated with the archery accessory.

In another aspect, the recess may comprise an elongated groove extending in a direction along the centerline plane. The elongated groove may include at least one receiver adapted for limiting movement of the archery accessory upon engagement of the archery accessory and the elongated groove.

The archery bow may further include a second vertical wall above the sight window, and the second vertical wall may comprise the at least one first mount. The at least one first mount may comprise one of a recess or an elongated ridge, the recess or elongated ridge extending in a direction along the centerline plane.

DETAILED DESCRIPTION OF THE INVENTION

The description provided below and in regard to the figures applies to all embodiments unless noted otherwise, and features common to each embodiment are similarly shown and numbered.

Figure 2:
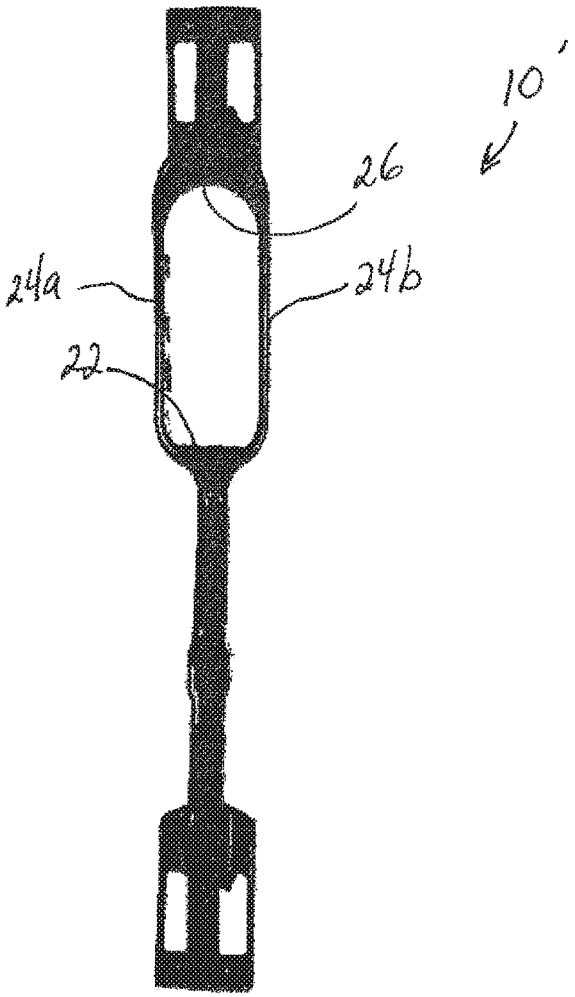
Fig. 2 (Prior Art)
FIG. 2 is a riser of a bow with a sight window including two vertical side walls of the prior art.
Figure 1:
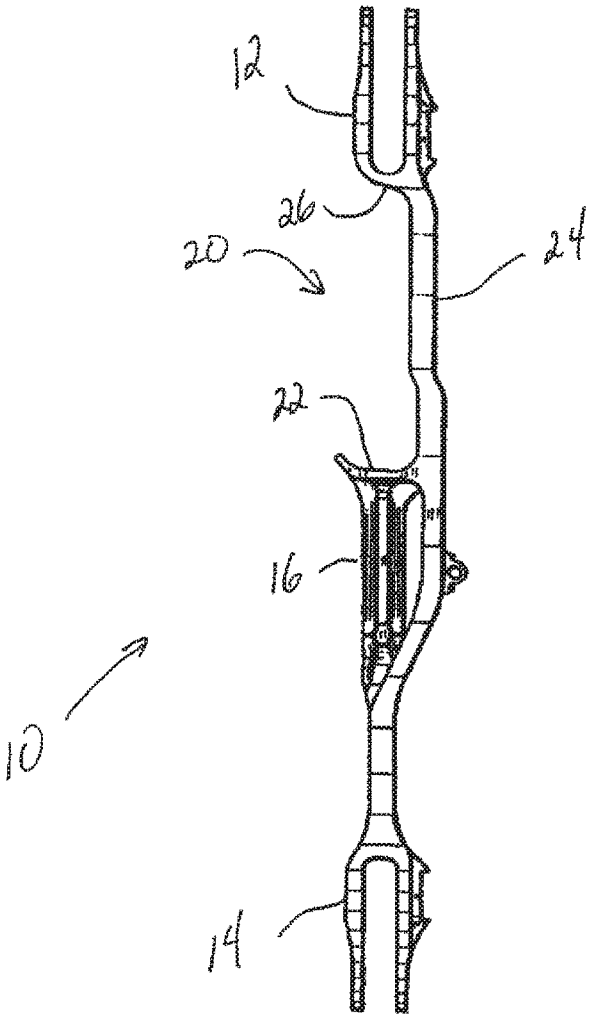
Fig. 1 (Prior Art)
FIG. 1 is a riser of a bow with a sight window including a single vertical side wall of the prior art.
Figure 3:
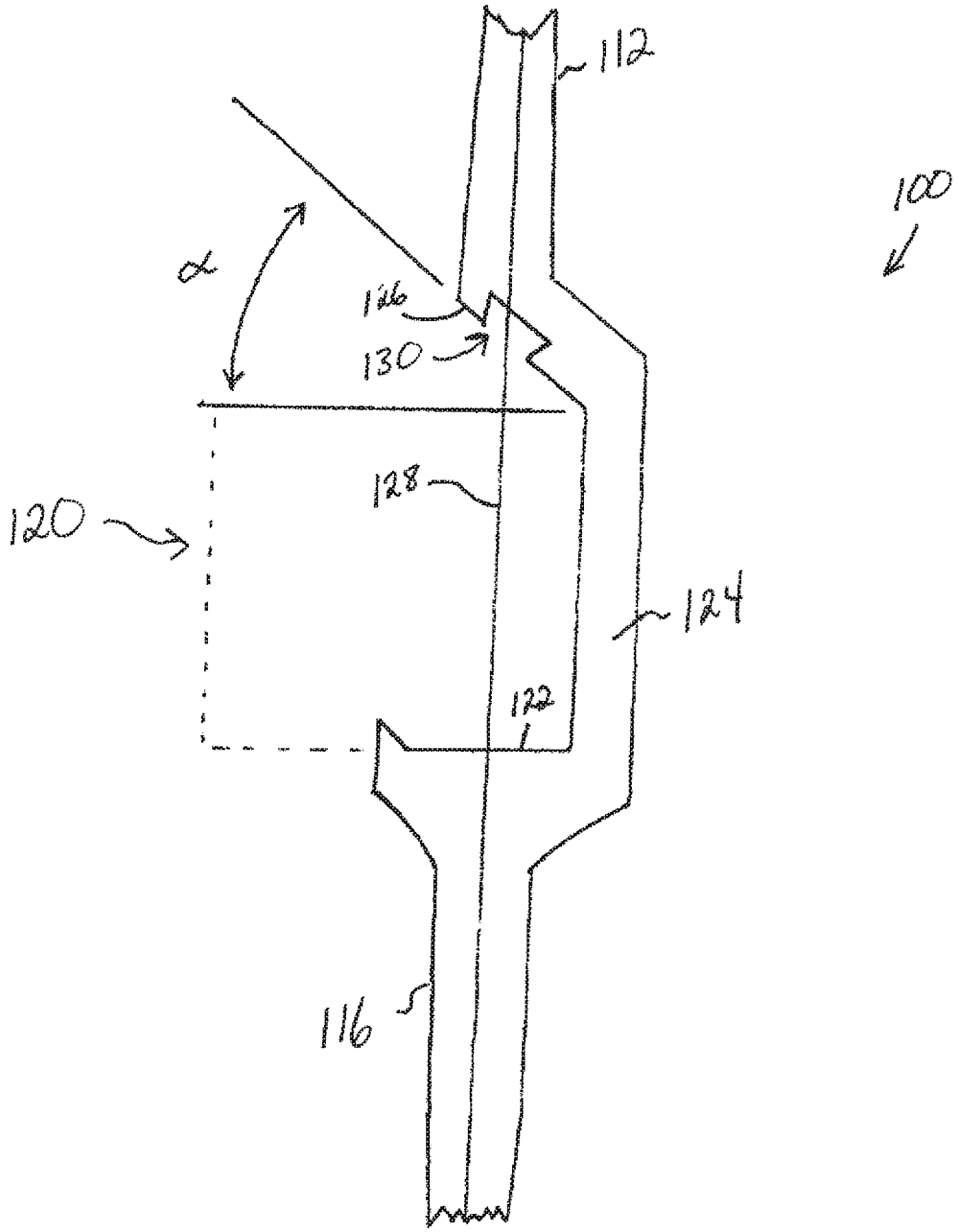
FIG. 3 is a partial rear cross-sectional view of an embodiment of a riser of the present invention.

With reference to FIG. 3, a riser 100 for an archery bow is illustrated, which includes an upper end 112, and a handle 116, the handle being adapted for a user to grip when firing an arrow. Between the upper end 112 and the handle 116 is a sight window 120. The sight window may be at least partially defined by a lower wall 122, a vertical side wall 124, and an upper wall 126. The lower wall 122 may be referred to as an arrow shelf.

In the illustrated embodiment of FIG. 3, the upper wall 126 may extend away from the vertical side wall 124 at an angle $\alpha$ with respect to horizontal. The angle $\alpha$ may be an angle between 0 and 90 degrees above horizontal, such as between 30 and 45 degrees. Alternately, the angle $\alpha$ may be an angle between 0 and 90 degrees below horizontal. In FIG. 3, the angle $\alpha$ is shown at approximately 40 degrees above horizontal.

The riser 100 may be adapted for use with a bowstring (not pictured), which is adapted to fire the arrow through the sight window 120. A path through which the bowstring travels while firing and arrow may define a centerline plane 128. This centerline plane 128 may generally divide the riser 100 into a left portion and right portion. In one aspect, the centerline plane 128 may divide the riser 100 in half between the left portion and the right portion. As illustrated, the centerline plane 128 extends from a front to a back of the riser 100, and is perpendicular to the plane of the cross-section of the riser 100 as illustrated.

At least one mount 130 may be provided in the upper wall 126 of the sight window. The mount 130 may be positioned at least partially within the centerline plane 128. In one aspect, the mount 130 may be centered within the centerline plane 128. The mount 130 may be adapted to engage an archery accessory and affix the archery accessory to the riser 100. For example, the archery accessory may comprise any of an arrow rest, a sight, a cable guard, a range finder, a scope, a flashlight, a camera, a fishing reel, or a stabilizer. The mount 130 may take one of many forms, such as those outlined below.

Figure 4:
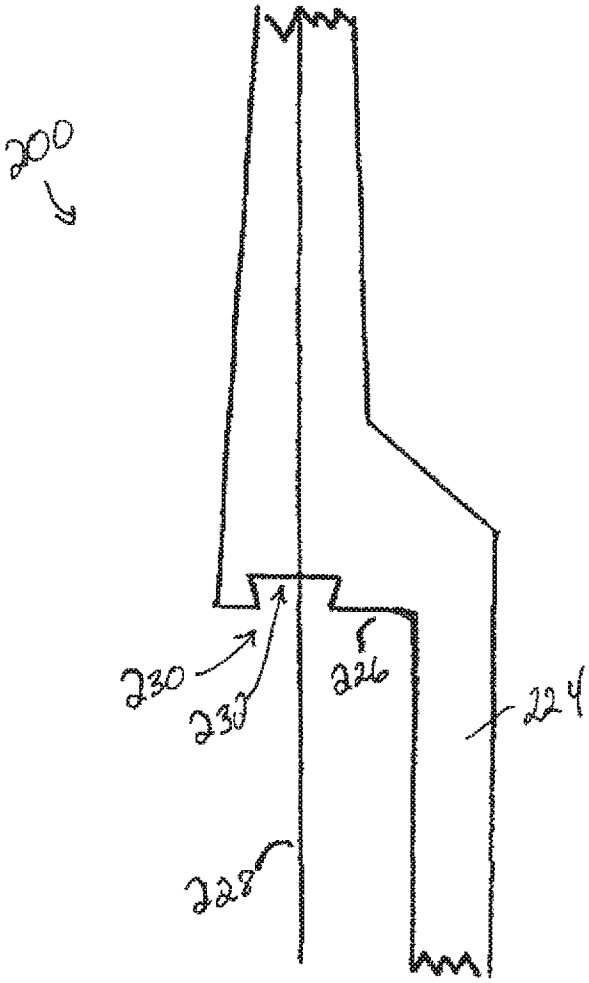
FIG. 4 is a partial rear cross-sectional view of a second embodiment of a riser of the present invention.

With further reference to FIG. 4, a partial cross-section of a riser 200 is shown, which includes a sight window. A mount 230 may be provided in an upper wall 226 of the sight window. The mount 230 may be located within a centerline plane 228, and may be centered on the centerline plane 228. In the embodiment of FIG. 4, the upper wall 226 is a horizontal wall, and extends approximately 90 degrees from a sidewall 224 of the sight window.

The mount 230 may comprise a recess 232, which is adapted for receiving at least a portion of the archery accessory. For example, the recess 232 may comprise a female connector, which may be adapted to mate with a male connector or extension on the archery accessory. The recess 232 may be a slot or groove running in a direction from a front to a back of the riser, such as along the centerline plane 228. A cross-sectional shape of the recess 232 may be rectangular, trapezoidal, polygonal, or may include a rounded or arcuate cross-section. In one aspect, the recess 232 may comprise a dovetail slot, or may be a slot for receiving a picatinny rail or a weaver rail.

Figure 5:
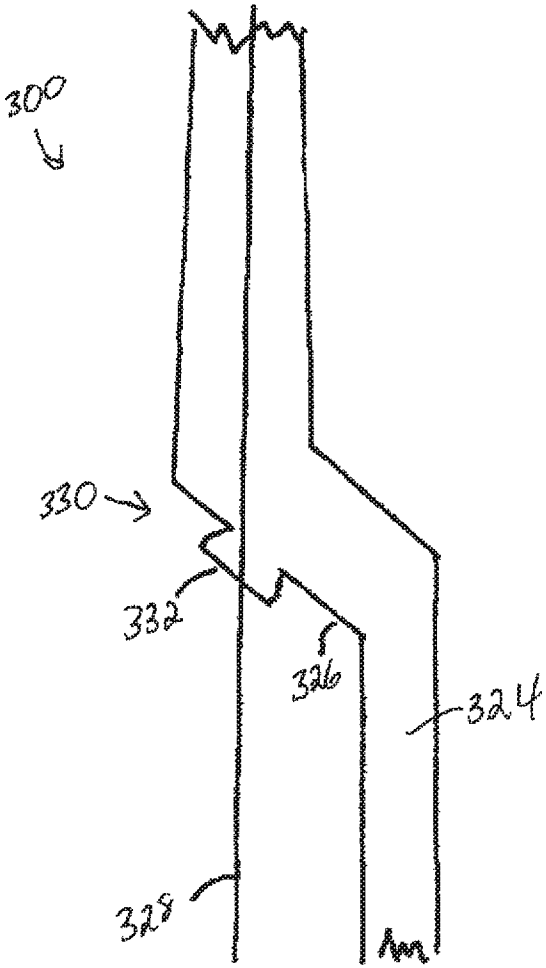
FIG. 5 is a partial rear cross-sectional view of a third embodiment of a riser of the present invention.

Turning to FIG. 5, a partial cross-section of a riser 300 is illustrated, including a sight window at least partially defined by a vertical side wall 324 and an upper wall 326. As illustrated in FIG. 5, the upper wall may extend from the vertical side wall 324 at an angle $\alpha$ with respect to horizontal.

The upper wall 326 may include a mount 330. The mount 330 may be provided at least partially within the centerline plane 328 of the riser 300. In a further aspect, the mount 330 may be centered within the centerline plane 328. The mount 330 may comprise an extension 332 projecting from the upper wall 326 into the sight window. The extension 332 may run in a direction from a front to a back of the riser, such as along the centerline plane 328. A cross-sectional shape of the extension 332 may be rectangular, trapezoidal, polygonal, or may include a rounded or arcuate cross-section. In one aspect, the extension 332 may comprise a dovetail slide, or may be an extension such as that of a picatinny rail or a weaver rail.

Figure 6:
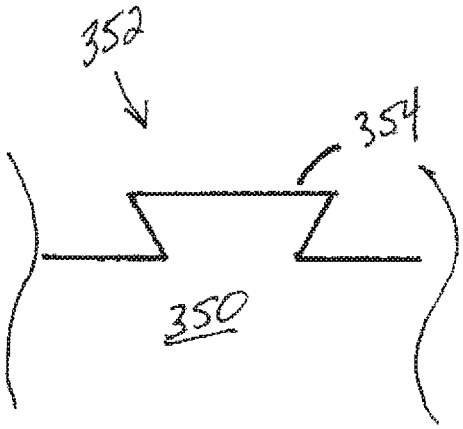
FIGS. 6 and 7 are rear partial cross-sectional views of archery accessories adapted to engage a riser.
Figure 7:
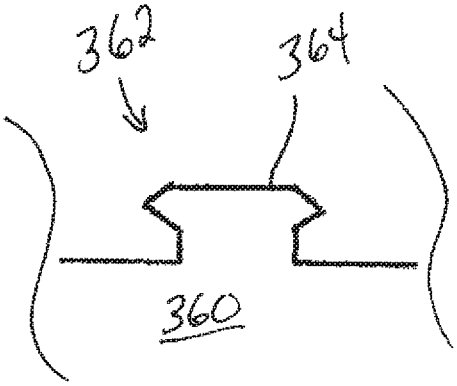

FIG. 6 illustrates a partial cross-section of a first archery accessory 350, which includes a connector 352 adapted to engage the mount of a riser. The connector 352 is illustrated as a first projection 354, which may be adapted to be received within a recess 232 of a riser 200. The shape of the projection 354 may correspond to a shape of the recess 232, thereby affixing the archery accessory 350 to the riser 200. Similarly, FIG. 7 illustrates a second archery accessory 360, which includes a connector 362 in the form of a second projection 364. The second projection 364 may be a different shape than the projection 354 of the first archery accessory 350. As illustrated, the first projection 354 of the first archery accessory 350 is a dovetail slide, while the second projection 364 of the second archery accessory 360 is a picatinny rail slide. A given connector 352, 362, may have a corresponding shape to a recess 232 of a given shape, thereby being specifically adapted to engage a specifically shaped recess.

Similarly, in the case of a mount 330 of a riser 300 being in the form of an extension 332, a corresponding archery accessory may be equipped with a receiver of a corresponding shape, thereby allowing the extension 332 to engage the receiver of the archery accessory, attaching and fixing the archery accessory to the riser 300.

Figure 8B:
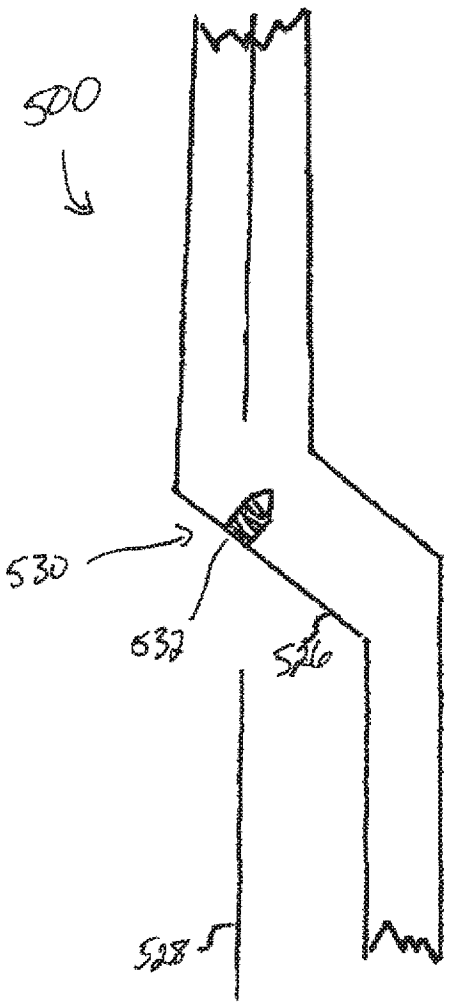
FIGS. 8A and 8B are partial rear cross-sectional views of other embodiments of a riser.
Figure 8A:
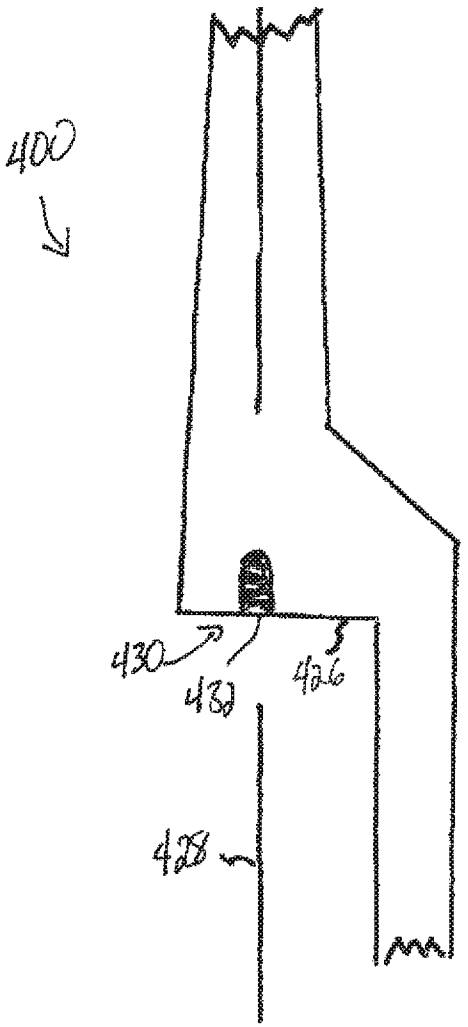

In another aspect, as shown in FIG. 8A, a riser 400 with a sight window at least partially formed by a horizontal upper wall 426, may include a mount 430, which may take the shape of a threaded aperture 432. As with other embodiments, the threaded aperture 432 may be positioned at least partially within a centerline plane 428 of the riser 400, and more specifically may be centered within the centerline plane 428.

FIG. 8B illustrates a similar embodiment to that of FIG. 8A, in which a riser 500 includes a mount 530 in the form of a threaded aperture 532. The threaded aperture 532 may be located at least partially within the centerline plane 528 of the riser 500. The mount 530 may be associated with an upper wall 526 of the sight window, which may project from a vertical side wall of the sight window at an angle at with respect to horizontal.

Figure 9B:
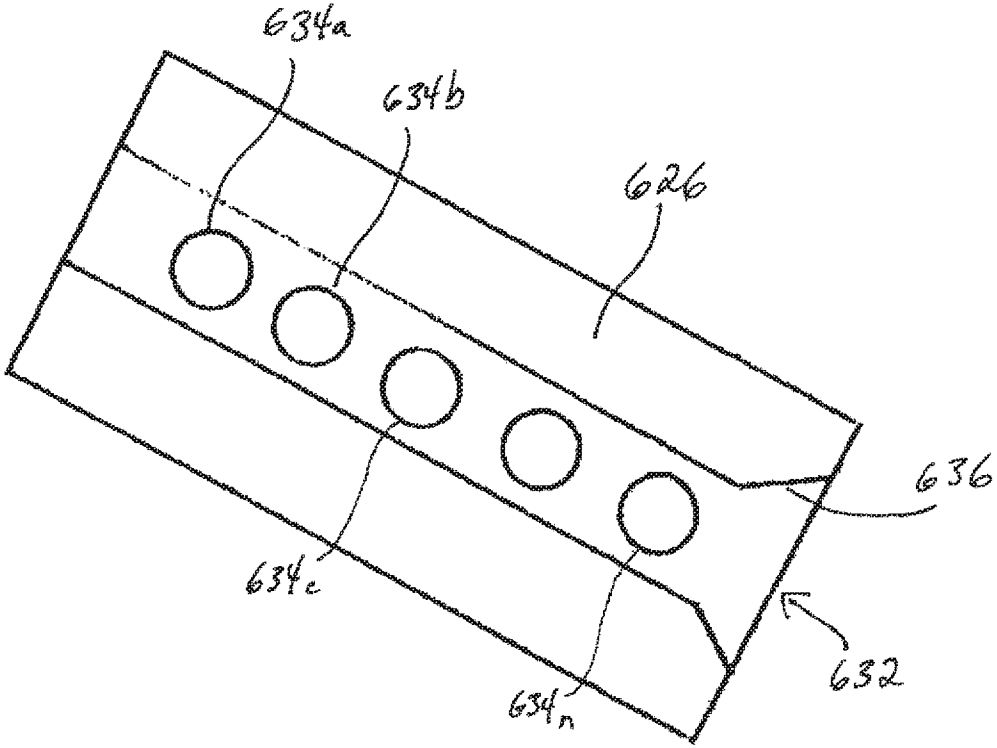
FIG. 9B is a bottom plan view of the mount of FIG. 9A.
Figure 9A:
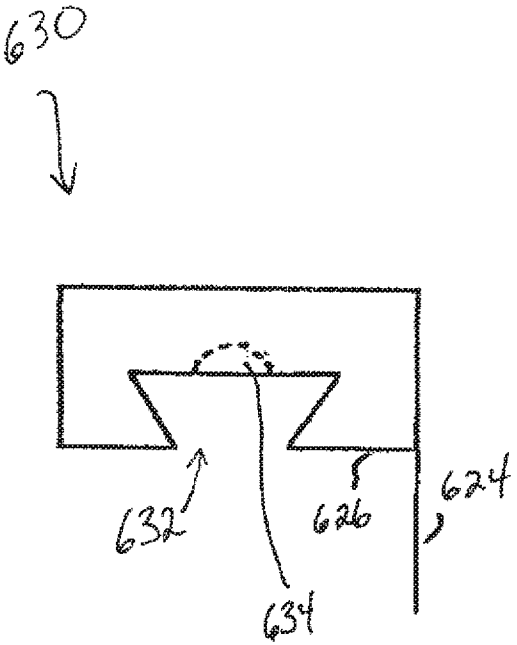
FIG. 9A is a partial rear cross-sectional view of one embodiment of a mount of a riser.

In a further aspect, FIGS. 9A and 9B illustrate a mount 630, which may be provided in an upper wall 626 of a riser. As above, the upper wall 626 of the riser may at least partially define a sight window in combination with at least one vertical side wall 624 of the riser. The mount 630 may comprise a recess 632, which may comprise a cross-sectional shape as disclosed above. As illustrated, the recess 632 may comprise an elongated groove, which may run in a direction from a front to a back of the upper wall, such as along the centerline plane.

In the recess 632, one or more receivers 634 may be provided. The receivers 634 may be adapted to engage the archery accessory and restrict movement of the archery accessory, such as in a direction along the elongated groove. The receiver 634 may comprise an indentation adapted to engage a detent associated with the archery accessory. As shown in FIG. 9B, the receiver may include a plurality of receivers 634*a*, 634*b* . . . 634*n*. This plurality of receivers may allow for selective engagement of a single projecting element of the archery accessory, such as a detent, with an individual receiver in order to select a particular position of the archery accessory along a length of the groove. Alternately, the plurality of receivers may allow for the simultaneous engagement of a plurality of projecting elements from the archery accessory, such as a plurality of detents, in order to more securely fasten the archery accessory to the riser. The elongated groove may further include an opening 636 that may be wider at one point than another, and may be adapted to receive a portion of the archery accessory.

Figure 10B:
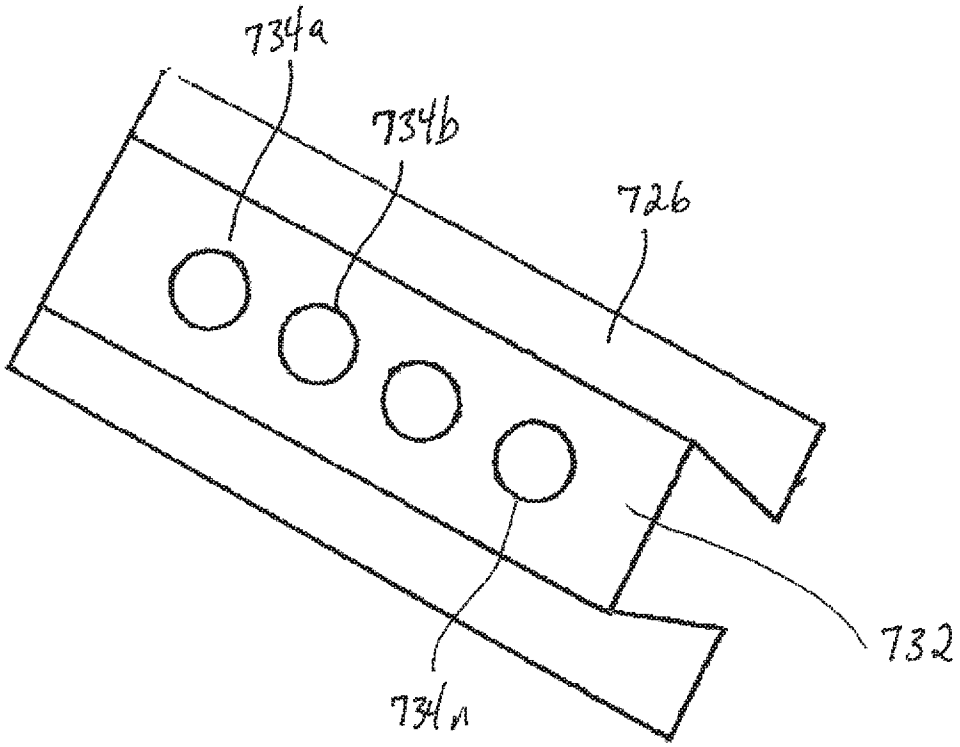
FIG. 10B is a bottom plan view of the mount of FIG. 10A.
Figure 10A:
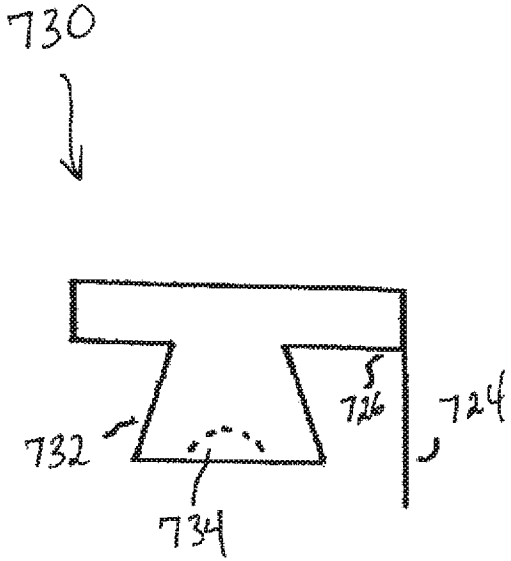
FIG. 10A is a partial cross-sectional view of another embodiment of a mount of a riser.

Similarly, with reference to FIGS. 10A and 10B, a mount 730 is illustrated, which may be provided in an upper wall 726 of a riser. The upper wall 726 may at least partially define a sight window in combination with at least one vertical side wall 724. The mount 730 may comprise an extension 732, which may project from the upper wall 726 into the sight window. The extension 732 may also extend in a direction running from front to back of the upper wall 726, such as along the centerline plane.

The extension 732 may include one or more receivers 734, which may be adapted to engage the archery accessory and restrict movement of the archery accessory, such as in a direction along the centerline plane. The receiver 734 may comprise an indentation adapted to engage a detent associated with the archery accessory. As shown in FIG. 10B, the receiver may include a plurality of receivers 734*a*, 734*b*, . . . 734*n*. This plurality of receivers may allow for selective engagement of a single projecting element of the archery accessory, such as a detent, with an individual receiver in order to select a particular position of the archery accessory along a length of the extension 732 from the front to back of the riser. Alternately, the plurality of receivers may allow for the simultaneous engagement of a plurality of projecting elements from the archery accessory, such as a plurality of detents, in order to more securely fasten the archery accessory to the riser.

Figure 11B:
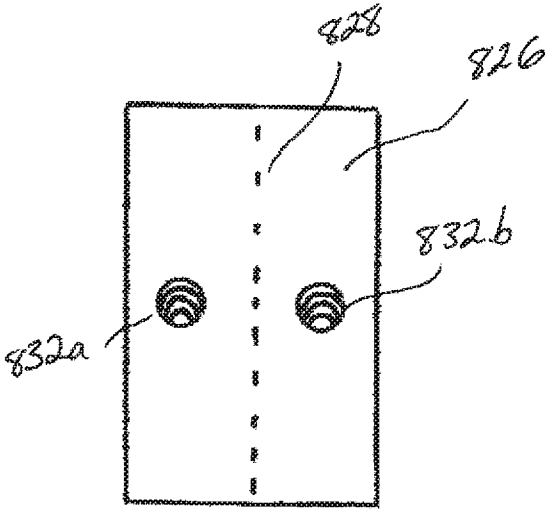
FIG. 11B is a bottom view of a mount of the riser of FIG. 11A.
Figure 11A:
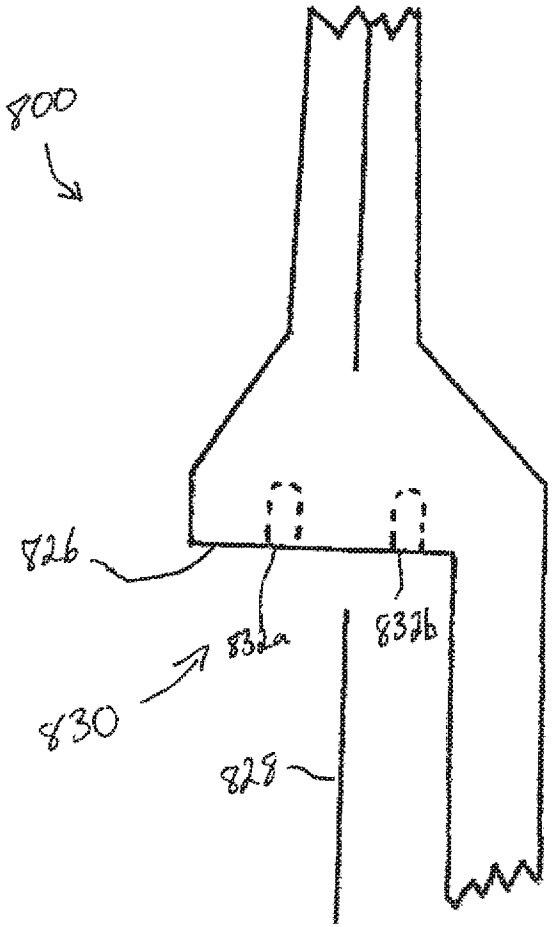
FIG. 11A is a partial rear cross-sectional view of a further embodiment of a riser.

With reference to FIGS. 11A and 11B, a further aspect of a riser 800 is illustrated, wherein a mount 830 may be provided in the upper wall 826 of a sight window of the riser. The mount 830 may comprise a plurality of apertures 832*a*, 832*b*, which may be positioned symmetrically with respect to a centerline plane 828 of the riser 800. As shown, two apertures 832*a*, 832*b* are present, with each of the apertures being equidistant from the centerline plane 828. In one aspect, the plurality of apertures 832*a*, 832*b* may be threaded apertures. The apertures 832*a*, 832*b* may be adapted to engage projections, such as posts or threaded screws, from the archery accessory.

Figure 12B:
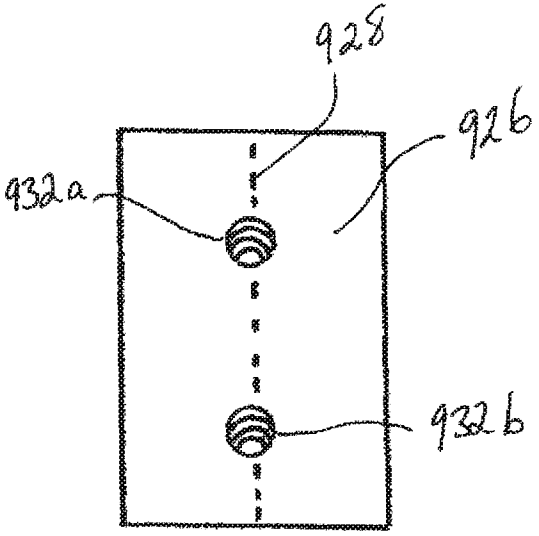
FIG. 12B is a bottom view of a mount of the riser of FIG. 12A.
Figure 12A:
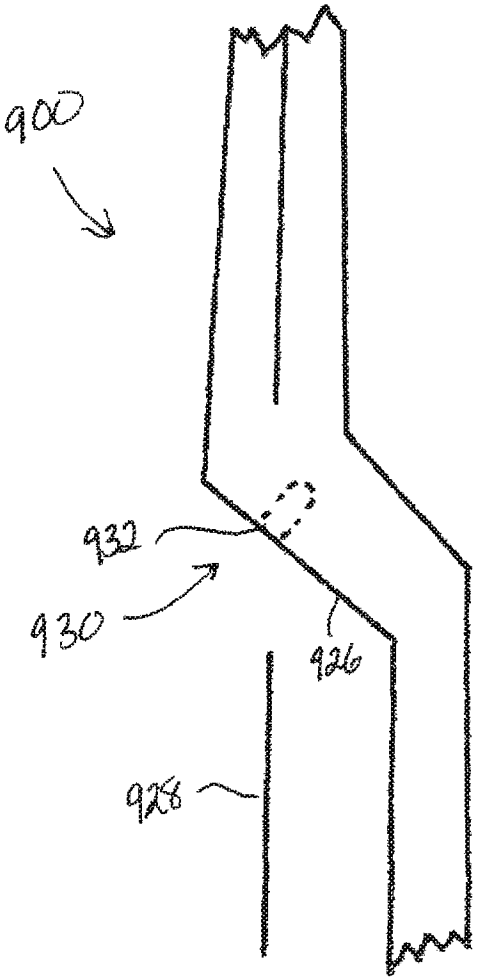
FIG. 12A is a partial rear cross-sectional view of another embodiment of a riser.

Similarly, FIGS. 12A and 12B illustrate a similar embodiment of a riser 900, which includes a mount 930 in an upper wall 926, said mount 930 comprising a plurality of apertures 932*a*, 932*b*. The apertures 932*a*, 932*b* may be positioned along the centerline plane 928 of the riser 900. As can be seen in FIG. 12B, each of the plurality of apertures 932*a*, 932*b* may be positioned within the centerline plane 928. In one aspect, the plurality of apertures 932*a*, 932*b* may be threaded apertures. The apertures 932*a*, 932*b* may be adapted to engage projections, such as posts or threaded screws, from the archery accessory.

Figure 13:
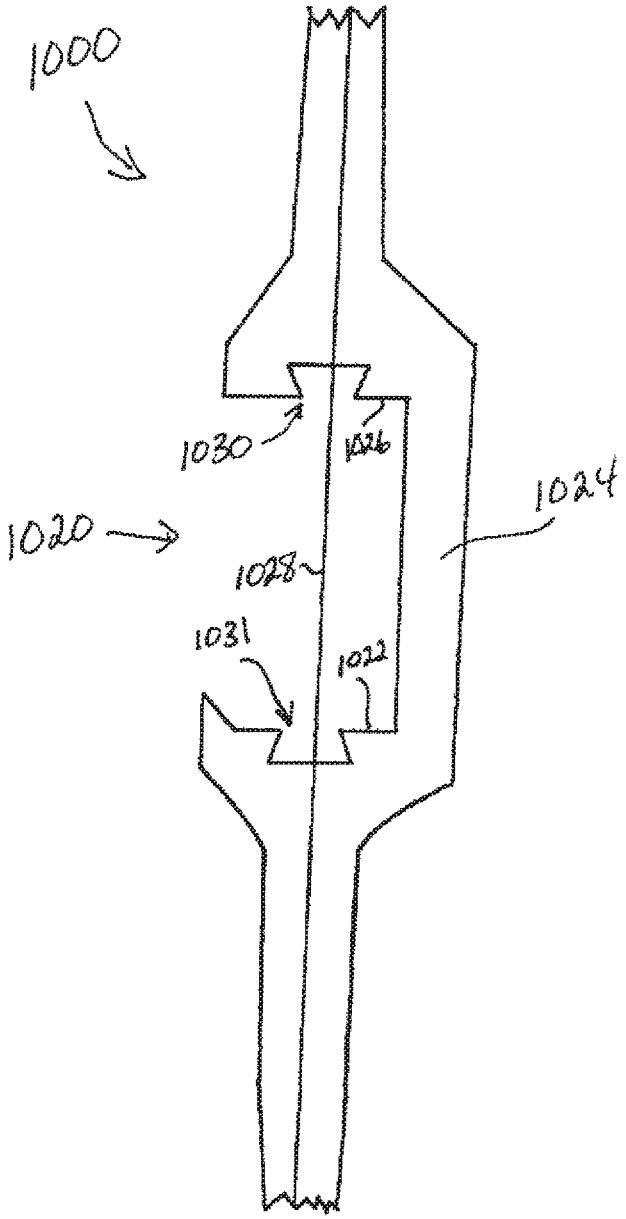
FIG. 13 is a partial rear cross-sectional view of an additional embodiment of a riser.

Turning to FIG. 13, a riser 1000 is depicted, which includes a sight window 1020, which is at least partially defined by a lower wall 1022, at least one vertical side wall 1024, and an upper wall 1026. As in other embodiments, a first mount 1030 may be provided in the upper wall 1026. In addition, at least one second mount 1031 may be provided in the sight window. As shown, the at least one second mount 1031 may be provided in the lower wall 1022. One or both of the first mount 1030 and the second mount 1031 may be provided at least partially within the centerline plane 1028 of the riser 1000. Alternately, the second mount 1031 could be provided in the at least one vertical side wall 1024. Each of the first mount 1030 and the second mount 1031 may be of the configuration of any of the mounts described herein.

Figure 14:
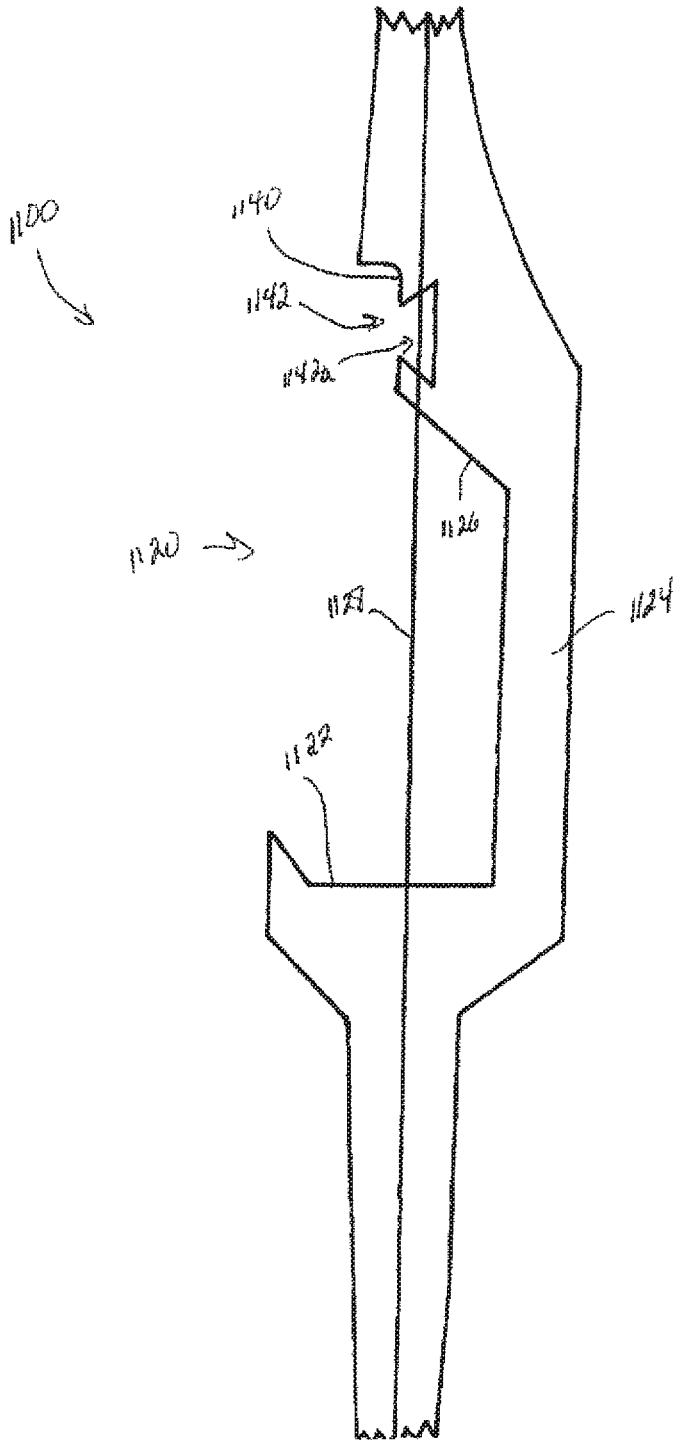
FIG. 14 is a partial rear cross-sectional view of an embodiment of a riser with a second vertical wall including a mount.

In another aspect, a riser may include a mount outside the sight window, but at least partially overlapping with a centerline plane of the riser. As illustrated in FIG. 14, a riser 1100 is illustrated, which includes a sight window 1120, defined at least partially by a lower wall 1122, a first vertical side wall 1124 of the sight window, and an upper wall 1126. The upper wall 1126 may extend away from the first vertical side wall 1124 at an angle α with respect to horizontal. The angle α may be an angle between 0 and 90 degrees above horizontal, such as between 30 and 45 degrees. Alternately, the angle α may be an angle between 0 and 90 degrees below horizontal. In FIG. 14, the angle α is shown at approximately 40 degrees above horizontal.

The riser 1100 may further include a second vertical wall 1140 outside the sight window 1120. The second vertical wall 1140 may be above the sight window 1120 (as shown in FIG. 14) or below the sight window 1120. The second vertical wall 1140 may include a mount 1142. The mount 1142 may be positioned at least partially within the centerline plane 1128. In one aspect, the mount 1142 may be centered within the centerline plane 1128. The mount 1142 may be similar to other mounts outlined herein, and may be adapted to engage an archery accessory and affix the archery accessory to the riser 1100. For example, the archery accessory may comprise any of an arrow rest, a sight, a cable guard, a range finder, a scope, a flashlight, a camera, a fishing reel, or a stabilizer. The mount 1142 may take one of many forms, such as those outlined herein.

The mount 1142 may comprise a recess 1142*a*, which is adapted for receiving at least a portion of the archery accessory. For example, the recess 1142*a* may comprise a female connector, which may be adapted to mate with a male connector or extension on the archery accessory. The recess 1142*a* may be a slot or groove running in a direction from a front to a back of the riser, such as along the centerline plane 1128. A cross-sectional shape of the recess 1142*a* may be rectangular, trapezoidal, polygonal, or may include a rounded or arcuate cross-section. In one aspect, the recess 1142*a* may comprise a dovetail slot, or may be a slot for receiving a picatinny rail or a weaver rail.

The recess 1142*a* associated with the second vertical wall 1140 may take a similar form to those described above with respect to FIGS. 9A and 9B. For example, the recess 1142*a* may comprise an elongated groove, which may run in a direction from a front to a back of the second vertical wall 1140, such as along the centerline plane 1128. The recess 1142*a* may include one or more receivers along the elongated groove which may be adapted to engage the archery accessory and restrict movement of the archery accessory, such as in a direction along the elongated groove. The receiver 1142*a* may comprise one or more indentations adapted to engage one or more detents associated with the archery accessory as shown and described with respect to FIG. 9B. Furthermore, as illustrated in FIG. 9B, the elongated groove of recess 1142*a* may further include an opening that may be wider at one point than another, and may be adapted to receive a portion of the archery accessory.

Figure 15:
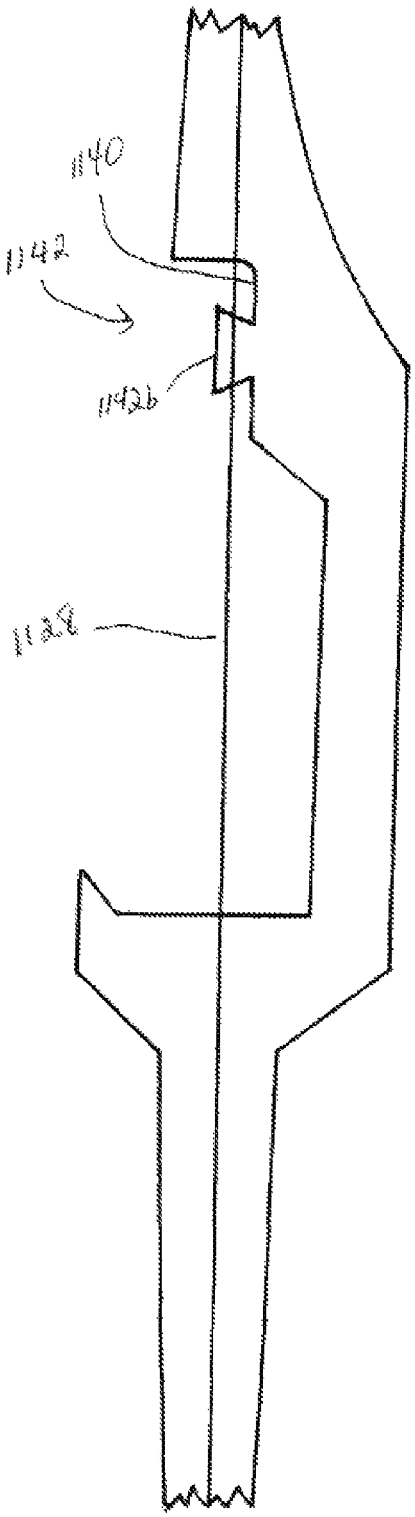
FIG. 15 is another embodiment of the riser of FIG. 14.

With further reference to FIG. 15, the mount 1142 in the second vertical wall 1140 above the sight window may comprise an extension 1142*b*. As illustrated, the extension 1142*b* may be provided at least partially within the centerline plane 1128 of the riser 1100. In one aspect, the extension 1142*b* may be centered within the centerline plane 1128. The extension 1142*b* may run in a direction from a front to a back of the riser, such as along the centerline plane 1128. A cross-sectional shape of the extension 1142*b* may be rectangular, trapezoidal, polygonal, or may include a rounded or arcuate cross-section. In one aspect, the extension 1142*b* may comprise a dovetail slide, or may be an extension such as that of a picatinny rail or a weaver rail.

The extension 1142*b* associated with the second vertical wall 1140 may take a similar form to those described above with respect to FIGS. 10A and 10B. For example, the extension 1142*b* may include one or more receivers along the extension, which may be adapted to engage the archery accessory and restrict movement of the archery accessory, such as in a direction along the centerline plane. The one or more receivers may comprise an indentation adapted to engage a detent associated with the archery accessory, as described and illustrated with respect to FIG. 10B.

Figure 16:
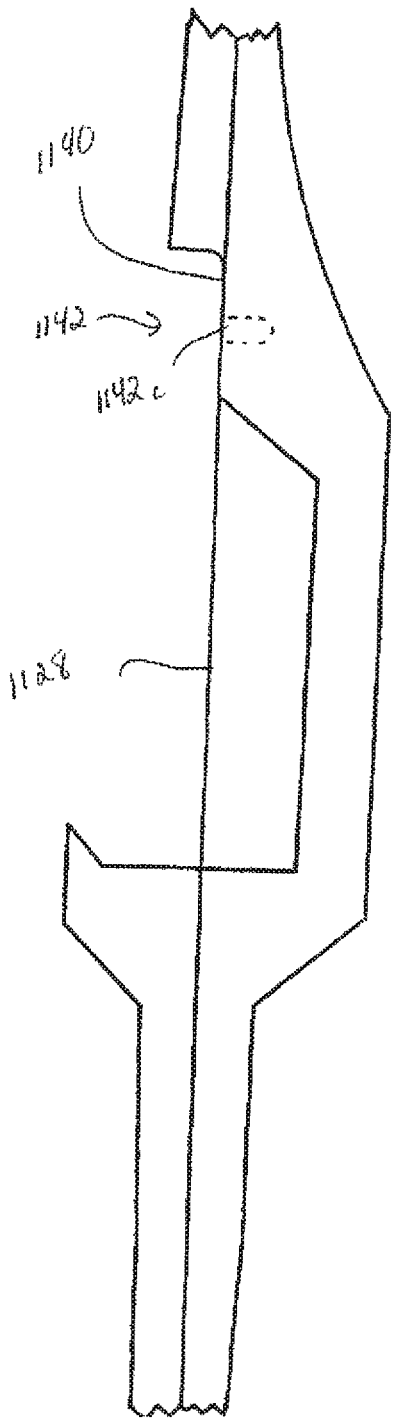
FIG. 16 is a further embodiment of the riser of FIG. 14.

FIG. 16 illustrates a further aspect of the invention. As illustrated, the mount 1142 in the second vertical wall 1140 may comprise a threaded aperture 1142*c*. As with other embodiments, the threaded aperture 1142*c* may be positioned at least partially within or bordering a centerline plane 1128 of the riser 1100, and may be centered within the centerline plane 1128. In one aspect, the threaded aperture 1142*c* may form a cavity that is perpendicular to the second vertical wall 1140.

In one aspect, the threaded aperture 1142*c* in the second vertical wall 1140 may comprise a plurality of threaded apertures, such as those of FIGS. 11A-12B. For example, the second vertical wall 1140 may include a pair of apertures which may be positioned symmetrically with respect to the centerline plane 1128. This may take the form of a pair of threaded apertures that are vertically aligned within the centerline plane 1128, with one above the other. Alternately, this may take the form of a pair of threaded apertures horizontally aligned in the centerline plane, with one forward along the riser 1100 with respect to the other. In any case, the threaded apertures may be adapted to engage projections, such as posts or threaded screws, from the archery accessory.

While not illustrated, the mount 1142 associated with the second vertical sidewall 1140 may be used in conjunction with a mount 1031 in the lower wall, such as is illustrated in FIG. 13.

A riser with a mount for an archery accessory provided within the centerline plane of the riser as described herein may offer advantages over a mount on a side vertical wall of the sight window of the riser. For example, locating and mounting an archery accessory along the centerline plane would prevent unwanted weight positioned off-center with respect to the bow, such as would be the case with mounting of the same accessory along the vertical sidewall of the sight window. Such off-centered weight can interfere with a user's ability to shoot an arrow along a desired path. In addition, the use of a mount aligned with a centerline plane of the riser prevents the need for adding an additional counterbalance weight stabilizer, thereby lowering the overall weight of the bow. In addition, providing a mount aligning with the centerline plane either in association with the upper wall of the sight window or in association with a vertical wall outside the sight window allows for placement of one or more archery accessories near or within the sight window without interfering with the flight of an arrow, which normally passes at or near the lower wall or arrow shelf. In the embodiment of a mount in both the upper wall (or in association with a second vertical wall above the sight window) and the lower wall, such a riser allows for coordinated location of an upper mount and a lower mount along the centerline plane of the riser. Accordingly, both an arrow rest and an additional archery accessory (e.g. a sight, a light, a camera, etc.) may be aligned with the centerline plane, thereby coordinating the function of two different accessories, while maintaining a balanced center of gravity of the overall bow.

While the invention has been described with reference to specific examples, it will be understood that numerous variations, modifications and additional embodiments are possible, and all such variations, modifications, and embodiments are to be regarded as being within the spirit and scope of the invention. For example, any of the embodiments of mounts described herein may be combined with any of the illustrated or described riser configurations (e.g. risers with two vertical side walls, risers with a horizontal upper wall of the sight window, risers with an angled upper wall of the sight window, etc.). Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. An archery bow riser comprising:

an upper end including left and right lateral walls and a pocket, said pocket at least partially defined by a vertical pocket wall closer to a centerline plane of the riser than are the left and right lateral walls;

a lower end;

a handle above the lower end; and a sight window between handle and the upper end, the sight window comprising:

a lower wall adjacent the handle;

at least one vertical side wall; and an upper wall; and at least one mount adapted to receive and attach an archery accessory to the riser, said mount located above the sight window and at least partially within the pocket, wherein the mount comprises an elongated groove running in a direction from a front to a back of the riser.

2. The archery bow riser of claim 1, wherein the mount is positioned on the vertical pocket wall.

3. The archery bow riser of claim 1, wherein the elongated groove includes at least one receiver adapted to engage the archery accessory and restrict movement of the archery accessory along the elongated groove.

4. The archery bow riser of claim 1, wherein at least one of the vertical side wall of the sight window and the lower wall further comprises a second mount adapted to receive and attach a second archery accessory to the riser.

5. The archery bow riser of claim 1, wherein the upper wall comprises a generally horizontal wall.

6. The archery bow riser of claim 1, wherein the upper wall extends from the at least one side vertical wall at an angle from horizontal greater than zero degrees.

7. An archery bow for use in association with a bowstring to fire an arrow, said bow comprising:

a riser including a centerline plane through which the bowstring is adapted to travel when firing said arrow;

wherein the riser includes a handle, a sight window above the handle, and an upper end above the sight window including left and right lateral walls, the sight window at least partially defined by a lower wall, a vertical side wall, and an upper wall;

wherein the upper end includes a pocket immediately above the sight window, said pocket at least partially defined by a vertical pocket wall, said vertical pocket wall closer to the centerline plane than are the left and right lateral walls of the upper end; and at least one first mount within the pocket and adapted to attach an archery accessory to the bow, wherein the first mount comprises a recess, the recess comprising a threaded aperture adapted to receive a threaded projection associated with the archery accessory.

8. The archery bow of claim 7, further including at least one second mount, said second mount associated with one of the vertical side wall or the lower wall.

9. The archery bow of claim 8, wherein the first mount and the second mount are the same shape.

10. The archery bow of claim 8, wherein the first mount and the second mount are different shapes.

11. The archery bow of claim 7, wherein the vertical pocket wall comprises the at least one first mount.

12. An archery bow riser comprising:

an upper end including left and right lateral walls and a pocket, said pocket at least partially defined by a vertical pocket wall closer to a centerline plane of the riser than are the left and right lateral walls;

a lower end;

a handle above the lower end; and a sight window between handle and the upper end, the sight window comprising:

a lower wall adjacent the handle;

at least one vertical side wall; and an upper wall; and at least one mount adapted to receive and attach an archery accessory to the riser, said mount located above the sight window and at least partially within the pocket, wherein the mount comprises an extension projecting from the riser.

13. The archery bow riser of claim 12, wherein the mount is positioned on the vertical pocket wall.

14. The archery bow riser of claim 12, wherein the extension runs in a direction from a front to a back of the riser.

15. The archery bow riser of claim 12, wherein at least one of the vertical side wall of the sight window and the lower wall further comprises a second mount adapted to receive and attach a second archery accessory to the riser.

16. The archery bow riser of claim 12, wherein the upper wall comprises a generally horizontal wall.

17. The archery bow riser of claim 12, wherein the upper wall extends from the at least one side vertical wall at an angle from horizontal greater than zero degrees.

18. An archery bow riser comprising:

an upper end including left and right lateral walls and a pocket, said pocket at least partially defined by a vertical pocket wall closer to a centerline plane of the riser than are the left and right lateral walls;

a lower end;

a handle above the lower end; and a sight window between handle and the upper end, the sight window comprising:

a lower wall adjacent the handle;

at least one vertical side wall; and an upper wall comprising a generally horizontal wall; and at least one mount adapted to receive and attach an archery accessory to the riser, said mount located above the sight window and at least partially within the pocket.

19. The archery bow riser of claim 18, wherein the mount is positioned on the vertical pocket wall.

20. The archery bow riser of claim 18, wherein the mount comprises a recess adapted to receive at least a portion of the archery accessory.

21. The archery bow riser of claim 18, wherein the mount comprises an elongated groove running in a direction from a front to a back of the riser.

22. The archery bow riser of claim 21, wherein the elongated groove includes at least one receiver adapted to engage the archery accessory and restrict movement of the archery accessory along the elongated groove.

23. The archery bow riser of claim 18, wherein the mount comprises an extension projecting from the riser.

24. The archery bow riser of claim 18, wherein the mount comprises an extension running in a direction from a front to a back of the riser.

25. The archery bow riser of claim 18, wherein at least one of the vertical side wall of the sight window and the lower wall further comprises a second mount adapted to receive and attach a second archery accessory to the riser.

26. An archery bow for use in association with a bowstring to fire an arrow, said bow comprising:

a riser including a centerline plane through which the bowstring is adapted to travel when firing said arrow;

wherein the riser includes a handle, a sight window above the handle, and an upper end above the sight window including left and right lateral walls, the sight window at least partially defined by a lower wall, a vertical side wall, and an upper wall;

wherein the upper end includes a pocket immediately above the sight window, said pocket at least partially defined by a vertical pocket wall, said vertical pocket wall closer to the centerline plane than are the left and right lateral walls of the upper end; and at least one first mount within the pocket and adapted to attach an archery accessory to the bow, said first mount comprising a recess, the recess being an elongated groove extending in a direction along the centerline plane.

27. The archery bow of claim 26, further including at least one second mount, said second mount associated with one of the vertical side wall or the lower wall.

28. The archery bow of claim 27, wherein the first mount and the second mount are the same shape.

29. The archery bow of claim 27, wherein the first mount and the second mount are different shapes.

30. The archery bow of claim 26, wherein the elongated groove includes at least one receiver adapted for limiting movement of the archery accessory upon engagement of the archery accessory and the elongated groove.

31. The archery bow of claim 26, wherein the vertical pocket wall comprises the at least one first mount.

* * * * *